US005174776A

United States Patent [19]

Ohtaka et al.

[11] Patent Number: 5,174,776

[45] Date of Patent: Dec. 29, 1992

[54] SWITCH TERMINAL AND CONNECTOR WITH SWITCH TERMINAL

[75] Inventors: Kazuto Ohtaka; Shigemitsu Inaba; Takashi Takagishi, all of Shizuoka, Japan

[73] Assignee: Yazaki Corporation, Tokyo, Japan

[21] Appl. No.: 800,093

[22] Filed: Nov. 29, 1991

[30] Foreign Application Priority Data

Nov. 29, 1990 [JP] Japan ..... 2-325380

[51] Int. Cl.[5] ..... H01R 16/639

[52] U.S. Cl. ..... 439/188; 439/488; 439/372; 439/884

[58] Field of Search ..... 439/188, 372, 488–490, 439/509, 911, 923, 884, 885; 200/51.09–51.11, 308, 310, 318, 321, 322

[56] References Cited

U.S. PATENT DOCUMENTS

| | | | |
|---|---|---|---|
| 3,973,919 | 8/1976 | Simon | 439/885 |
| 4,871,325 | 10/1989 | Maejima et al. | 439/372 |
| 4,878,853 | 11/1989 | Yamade et al. | 439/372 |
| 5,021,003 | 6/1991 | Ohtaka et al. | 439/372 |
| 5,034,644 | 7/1991 | Nakazato et al. | 439/188 |
| 5,034,727 | 7/1991 | Muraoka | 439/490 |
| 5,041,017 | 8/1991 | Nakazato et al. | 439/509 |
| 5,060,372 | 10/1991 | Capp et al. | 439/885 |

FOREIGN PATENT DOCUMENTS

| | | |
|---|---|---|
| 55-51731 | 4/1980 | Japan . |
| 60-19165 | 2/1985 | Japan . |
| 1-241778 | 9/1989 | Japan . |

*Primary Examiner*—Larry I. Schwartz
*Assistant Examiner*—Kevin J. Carroll
*Attorney, Agent, or Firm*—Sughrue, Mion, Zinn, Macpeak & Seas

[57] ABSTRACT

A connector comprises: a plurality of male housings each having terminal receiving chambers for receiving and retaining a female terminal; a female housing in which the male housings are fittingly received; a lock lever pivotally provided to the female housing, the lock lever being closed only when each of the male housing is completely lockingly fitted in the female housing; a first locking member provided to each of the male housings and the female housing for locking each other; a second locking member provided to each of the male housings and the lock lever for locking each of the male housings and the female housing each other; and electrical detecting member whether each of the male housings and the female housing are completely fitted and locked to each other or not.

8 Claims, 7 Drawing Sheets

SWITCH TERMINAL AND CONNECTOR WITH SWITCH TERMINAL

BACKGROUND OF THE INVENTION

This invention relates to an improved switch terminal and an improved connector with such a switch terminal.

Generally, with respect to a connector used for interconnecting wire harnesses, a pair of female and male housings are fitted together so as to connect metal terminals, received in these housings, together. In order to maintain electrical connection between these metal terminals, a lock member is provided between the two housings to prevent them from being disengaged from each other. In order to detect the fitted and locked condition of the two housings not by a lock sound or a visual inspection but by electrical means, there has been proposed a method in which a switch terminal is received in one of the two housings, and is adapted to be closed upon complete fitting between the housings.

FIG. 12 shows one example of such switch terminal (Japanese unexamined Utility Model Application No. 55-51731) in which a pair of main contact pieces d and d, which are urged by springs c and are short-circuited together by a short-circuit piece b before a test plug (not shown) is inserted into an insulating casing a from an opening a1 thereof, and a pair of auxiliary contact pieces e and e, which are contacted with the test piece before the main contact pieces d, are provided on inner surfaces of the casing a.

FIG. 13 shows another conventional example in which a switch mechanism is constituted by a fork-like contact piece f, having contact portions f1 and f1 of a bifurcated configuration, and a spring contact piece g having contact portions g1 and g1 of a saddle-like configuration for contacting with the contact portions f1 and f1 of a bifurcated configuration. The two contact pieces f and g are disposed at respective positions offset from the center of an insulating housing h in opposed relation to each other, and a central hole i is formed through a central portion of a front end of the insulating housing h, and a plug terminal (not shown) is passed through the central hole i to be engaged with the saddle-like contact portions g1 and g1 of the spring contact piece c so as to open and close the above switch mechanism.

In the above conventional switch terminals, the springs are used to apply a contact load to the contact portions (FIG. 12), and the fork-like contact piece and saddle-like spring contact piece of different shapes are used (FIGS. 13*a* and 13*b*). Therefore, the number of the component parts is large, and the constructions are complicated, and much time is required for the assembling, thus posing a problem that the operability is worse.

SUMMARY OF THE INVENTION

The present invention was made in order to solve the problems mentioned above. Accordingly, it is an object of this invention to provide a switch terminal which can be easily attached to a connector housing in a short time, and also to provide a connector in which whether or not the fitting condition is proper can be electrically detected using such a switch terminal.

In order to achieve the above object, according to the present invention, there is provided a switch terminal including a pair of connecting pieces each having a base plate portion which has a terminal portion at one end thereof and a spring contact portion at the other end thereof, the base plate portions of the two connecting pieces being interconnected in parallel relation to each other by a connective portion, each of spring contact portions being bent into an arcuate configuration from an outer side edge of the base plate portion toward an inner side edge thereof to provide a folded portion, and distal ends of the folded portions being capable of contacting each other to thereby provide a normally-closed contact.

According to another aspect of the invention, there is provided a connector with a switch terminal, comprising a switch terminal, and a connector housing having a switch terminal receiving chamber; the switch terminal including a pair of connecting pieces each having a base plate portion which has a terminal portion at one end thereof and a spring contact portion at the other end thereof, the base plate portions of the two connecting pieces being interconnected in parallel relation to each other by a connective portion, each of the spring contact portions being bent into an arcuate configuration from an outer side edge of the base plate portion toward an inner side edge thereof to provide a folded portion, and distal ends of the folded portions being capable of contacting each other to thereby provide a normally-closed contact; the switch terminal receiving chamber having at its wall surface a partition rib for isolating the pair of connecting pieces of the switch terminal from each other; guide walls which converge forwardly in a tapered manner being formed respectively on opposite side walls of the switch terminal receiving chamber at a terminal inlet portion thereof, the partition rib being disposed between the opposite side walls; upon insertion of the switch terminal into the switch terminal receiving chamber, a pair of spring contact portions are urged by the tapered guide walls, so that the ends of folded portions are contacted with each other to form the normally-closed contact; and a pair of connecting pieces being insulatively separated from each other by cutting off said connective portion.

In this connector with the switch terminal, there is provided a pivotal lock lever which is closed when a mating connector housing is completely lockingly fitted in the connector housing receiving the switch terminal, the lock lever having an insulating projection which can intrude between the ends of a pair of folded portions forming the normally-closed contact of the switch terminal, thereby breaking the normally-closed contact. With this arrangement, whether the fitting between the pair of connector housings is good or not can be electrically judged.

The switch terminal of the present invention is of a simple construction in which the pair of connecting pieces each having the terminal portion at one end thereof and the spring contact portion at the other end thereof are connected together by the connective portion. Thus, the switch terminal is provided as one component part, and therefore the number of component parts is greatly reduced as compared with the conventional constructions.

In order to form the connector with the switch terminal by the use of the switch terminal, the switch terminal is inserted into the switch receiving chamber, and the pair of spring contact portions are urged by the tapered guide walls, so that the ends of the folded portions are contacted with each other to form the normally-closed contact. At the same time, the connective portion is cut off to insulatively separate the pair of connecting pieces from each other. Thus, the assembling operation can be carried out easily in a short time.

DESCRIPTION OF THE PREFERRED EMBODIMENT

Figure 1:
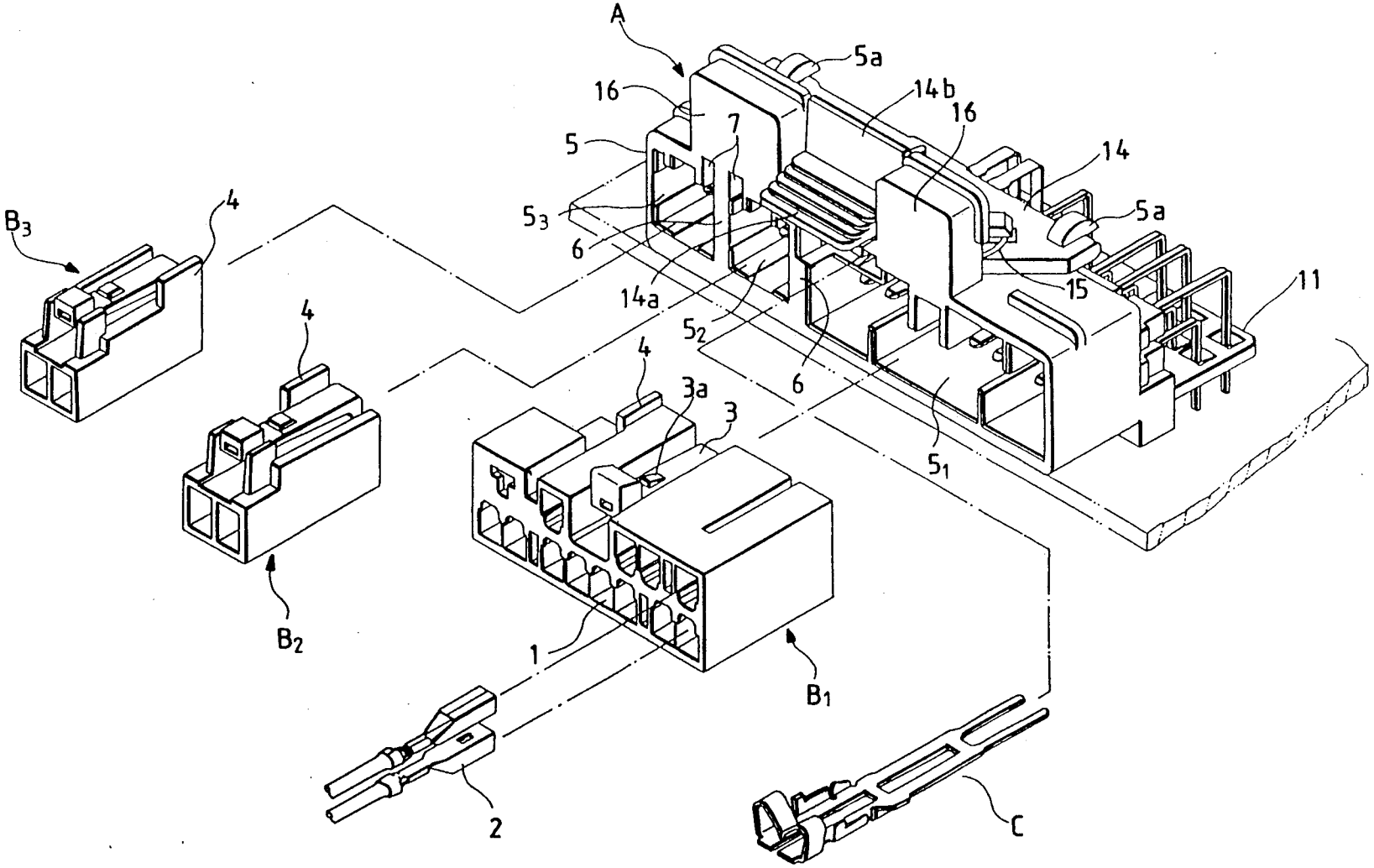
FIG. 1 is an exploded perspective view showing a switch terminal and a connector, provided in accordance with the present invention.

In FIG. 1, reference character A denotes a female housing of a synthetic resin, reference characters B1, B2 and B3 male housings, and reference character C a switch terminal. The female housing A is of a complex type, and is connected directly on a printed circuit board 11.

A plurality of juxtaposed terminal receiving chambers 1 are provided within the male housings B1, B2 and B3 (hereinafter represented by B1), and a female terminal 2 is received and retained in each of these chambers. A locking arm 3 with a retaining projection 3*a* for the female housing A, as well as a fitting confirmation projection 4, is formed on the outer surface of the male housing.

Figure 3:
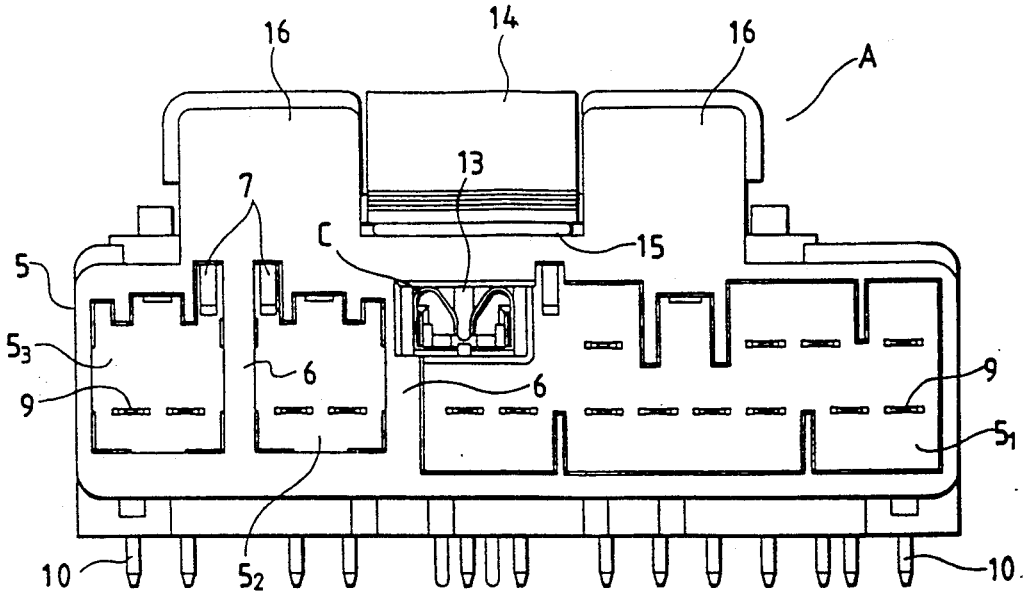
FIG. 3 is a front-elevational view of a female housing A.

The male housing A has a hood 5 formed at its front half portion, and as shown in FIG. 3, a plurality of juxtaposed tab insertion holes 9 are provided at the rear half portion thereof. L-shaped terminals 10 are press-fitted in the holes 9, respectively, and are connected to circuit conductors (not shown) of the printed circuit board 11 by soldering or the like.

The hood 5 has a plurality of partition walls 6 therein which divide the interior thereof into fitting chambers $5_1$, $5_2$ and $5_3$ for respectively receiving the male housings B1, B2 and B3. A slit 7 for receiving the fitting confirmation projection 4 of the male housing B, a slit 7' for an insulating projection 14*d* of a lock lever 14 (later described), and a retaining portion 8 (see FIG. 10) for engagement with the retaining projection 3*a* of the locking arm 3 are provided in each fitting chamber.

Figure 2A:
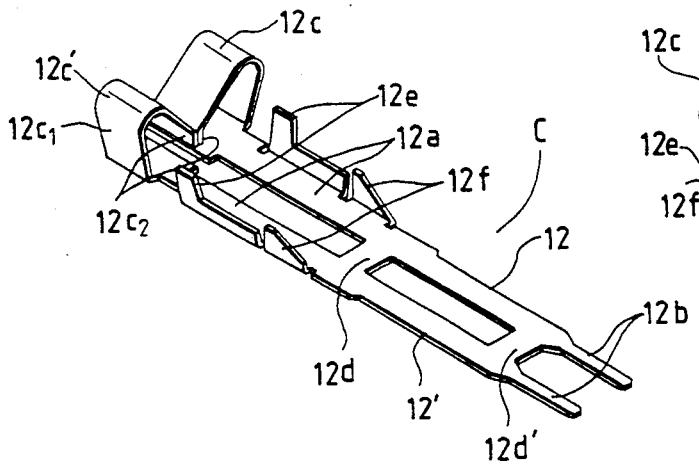
FIGS. 2*a* and 2*b* are an enlarged perspective view and a front-elevational view of the switch terminal, respectively.
Figure 2B:
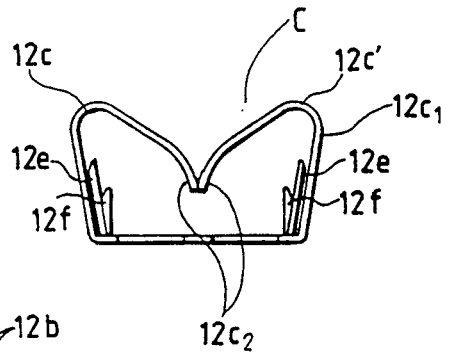

As shown on an enlarged scale in FIGS. 2*a* and 2*b*, the switch terminal C has a pair of parallel connecting pieces 12 and 12' connected together. The connecting piece 12 (12') has a base plate portion 12*a* having a terminal portion 12*b* formed at one end thereof, and a spring contact portion 12*c* (12*c'*) is formed at the other end of the base plate portion 12*a*. The base plate portions 12*a* and 12*a* are interconnected by connective portions 12*d* and 12*d'* intermediate the opposite ends thereof. The spring contact portion 12*c* (12*c'*) has an inclined side wall 12*c*1 extending from the outer side edge thereof away from the other spring contact portion, and the free end portion of the inclined side wall 12*c*1 is folded back inwardly into an arcuate shape to provide a folded portion. Distal ends 12*c*2 and 12*c*2 of the folded portions of the spring contact portions are normally contacted with each other to provide a normally-closing contact. A retaining piece 12*e* and a fixing piece 12*f* for bending purpose are formed on the outer side edge of the base plate portion 12*a* of each connecting piece 12 (12'), and are arranged in this order from the spring contact portion 12*c*. In this embodiment, although the terminal portion 12*b* of the connecting piece 12 serves as a connection pin directly connected to the printed circuit board 11, it may be formed as an ordinary tab-like male terminal or a corresponding female terminal.

As shown in FIG. 3, in addition to the tab insertion holes 9 for the L-shaped terminals 10, a switch terminal receiving chamber 13 is provided in the fitting chamber $5_1$ of the female housing A.

Figure 4:
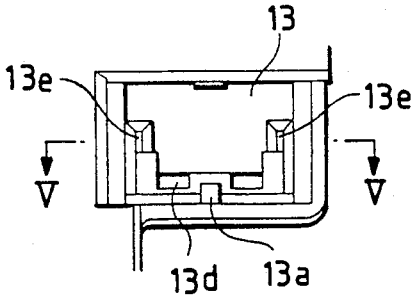
FIG. 4 is an enlarged front-elevational view of a switch receiving chamber of the female housing A.
Figure 5:
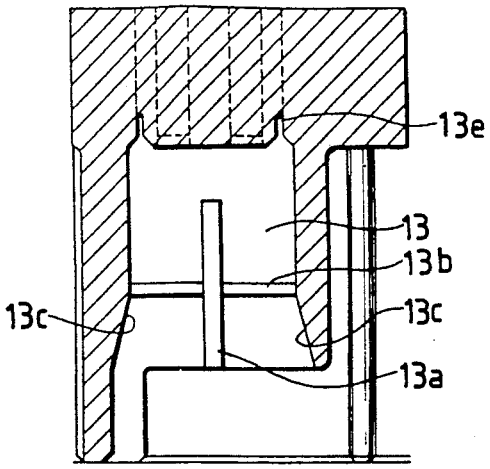
FIG. 5 is a cross-sectional view taken along the line V—V of FIG. 4.

As shown on an enlarged scale in FIGS. 4 and 5, in the switch terminal receiving chamber 13, a partition rib 13*a*, extending in the axial direction of the switch terminal C, and a transverse rib 13*b* intersecting the partition rib are formed on a bottom wall, and opposed side walls are tapered at a terminal inlet portion toward the front side to provide tapered guide walls 13*c* and 13*c*. An insertion hole 13*d* for the connecting piece 12 (12') of the terminal C and slits 13*e* and 13*e* for the retaining pieces 12*e* are formed in those walls disposed deeper than the tapered guide walls (see FIG. 4).

The switch terminal C is inserted into and attached to the switch terminal receiving chamber 13 in the following manner.

Figure 6:
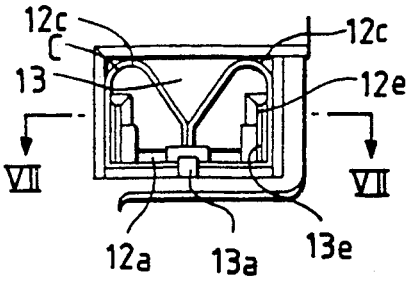
FIG. 6 is an enlarged front-elevational view of the switch receiving chamber into which the switch terminal C is inserted.
Figure 7:
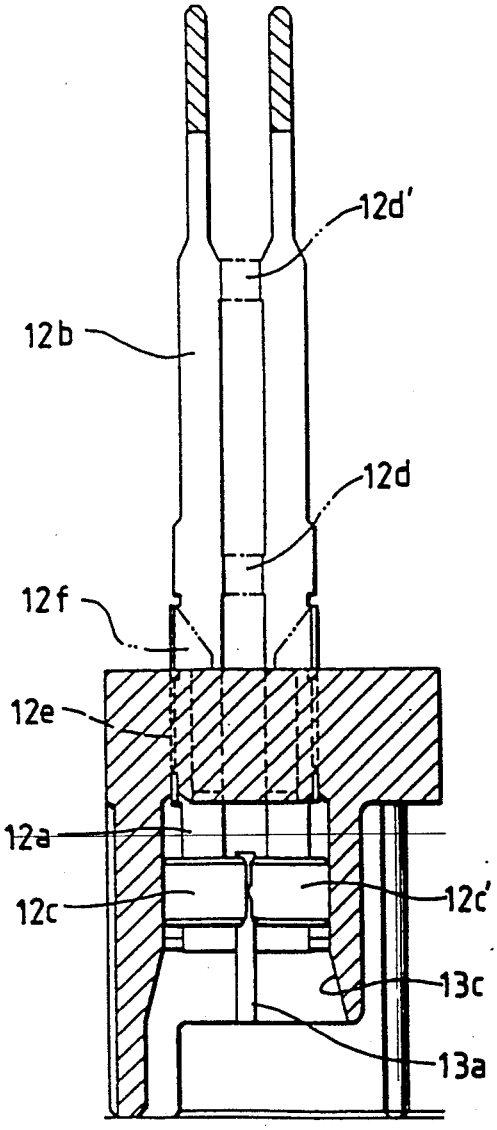
FIG. 7 is a cross-sectional view taken along the line VII—VII of FIG. 6.
Figure 8:
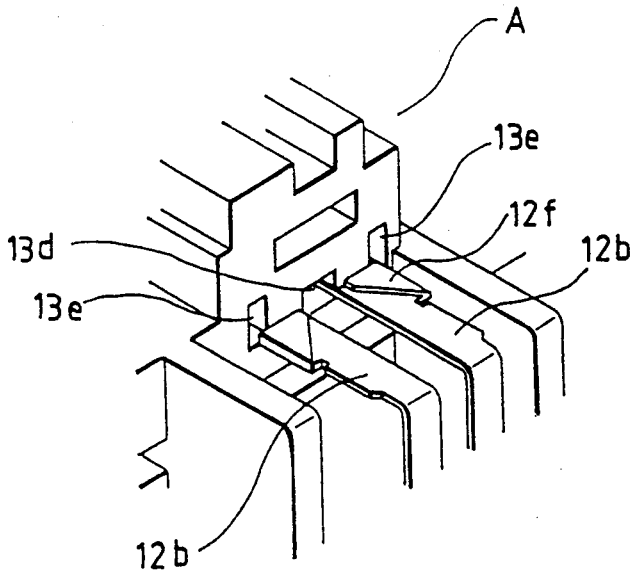
FIG. 8 is a perspective view of an important portion, showing the condition of insertion of the switch terminal C into the switch receiving chamber.

As shown in FIGS. 6 to 8, the switch terminal C is inserted into the switch terminal receiving chamber 13, so that the terminal portions 12*b* of the pair of connecting pieces 12 and 12' are passed through the insertion hole 13*d* and are projected forwardly. When the insertion further proceeds, the pair of spring contact portions 12*c* and 12*c'* advances in such a manner that their inclined side walls 12*c*1 are urged toward each other by the tapered guide walls 13*c* and 13*c*. When the retaining pieces 12*e* are engaged with the slits 13*e*, the insertion is stopped, and the ends 12*c*2 and 12*c*2 of the pair of spring contact portions 12*c* and 12*c'* are resiliently held in intimate contact with each other to thereby form a normally-closed contact. At this time, the connecting pieces 12*c* and 12*c'* are isolated from each other by the partition rib 13*a*, and each base plate portion 12*a* is seated on the inner portion of the transverse rib 13*b*. In this condition, the connective portions 12*d* and 12*d'* are cut off, and at the same time fixing pieces 12*f* and 12*f* are bent toward each other, thereby preventing the withdrawal of the switch terminal in front and rear directions, as shown in FIG. 8.

Referring again to FIG. 1, the lock lever 14, having a lock spring 15 mounted thereon, is pivotally connected at its one end to the rear portion of the hood portion 5 of the female housing A, and two lock plates 16 and 16 for holding the lever 14 in a provisionally-locked condition and in a completely-locked condition are formed on the front portion of the female housing A.

Figure 9:
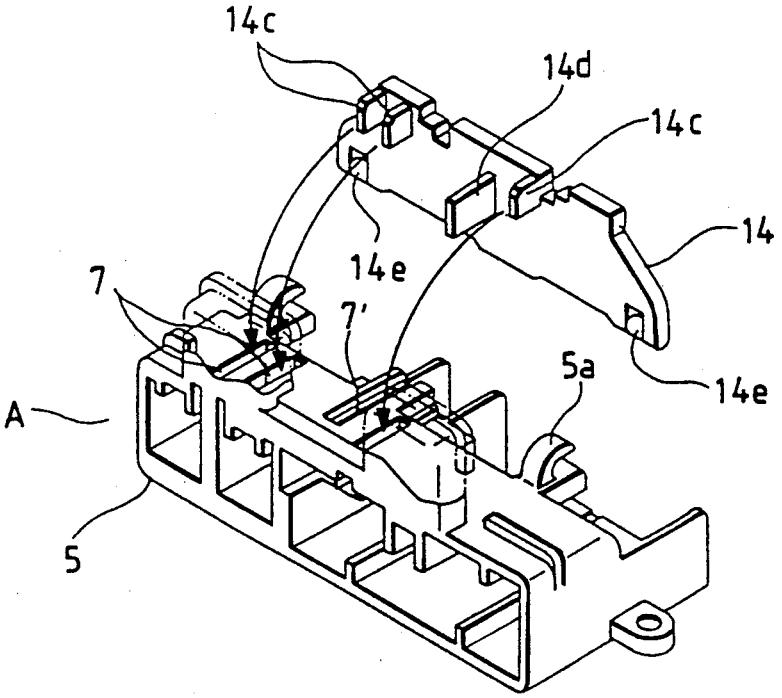
FIG. 9 is a perspective view showing the female housing A of FIG. 1 and a lock lever 14 separated therefrom.

The lock lever 14 has a plate-like configuration, and has an operating press portion 14*a* provided at the central portion of the front edge portion thereof, and a screen portion 14*b* extending upwardly from the press portion 14*a*. As shown in FIG. 9, fitting confirmation projections 14*c* for interfering respectively with the projections 4 of the male housings B1 to B3, as well as an insulating projection 14*d* for breaking the normally-closed contact of the switch terminal C, are formed on the reverse surface of the lock lever 14. The lock lever 14 has engagement holes 14*e* formed respectively in its opposite side portions at its rear edge portion, and these holes 14*e* are engaged respectively with C-shaped hooks 5*a*, formed at the rear end of the hood 5, so that the lock lever 14 is pivotally connected to the hood 5.

The lock plates 16 and 16 have a frame-like configuration, and a provisionally-locking groove 16*b* and a completely-locking groove 16*c* for engagement with the lock spring 15 are formed in each of opposed side walls 16*a* of the lock plates 16, the groove 16*b* being disposed above the groove 16*c*, as shown in FIG. 11. The completely-locking groove 16*c* is deeper than the provisionally-locking groove 16*b*.

Figure 10A:
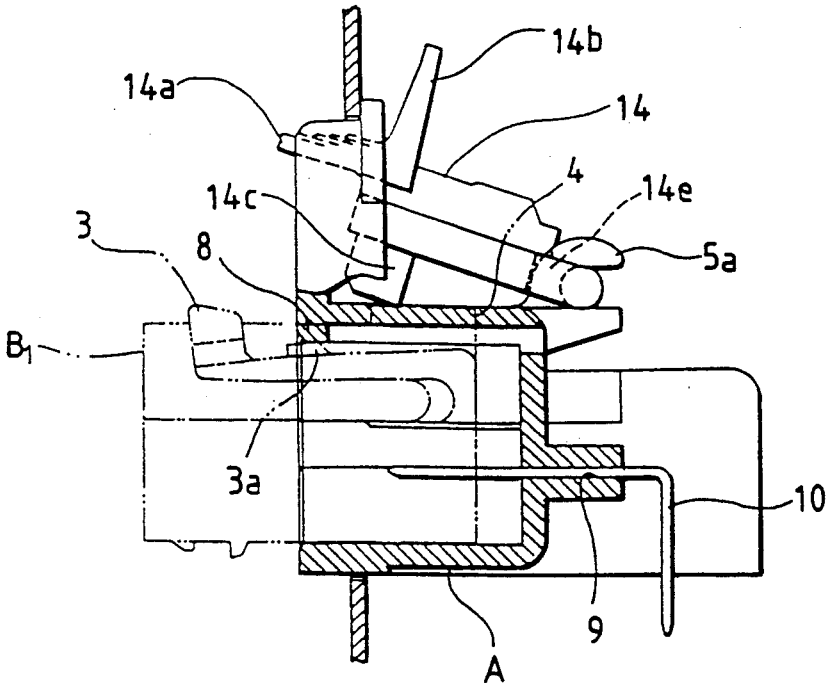
FIGS. 10*a* and 10*b* are fragmentary cross-sectional views showing the process of fitting of a male housing B1 into the female housing A of FIG. 1.
Figure 10B:
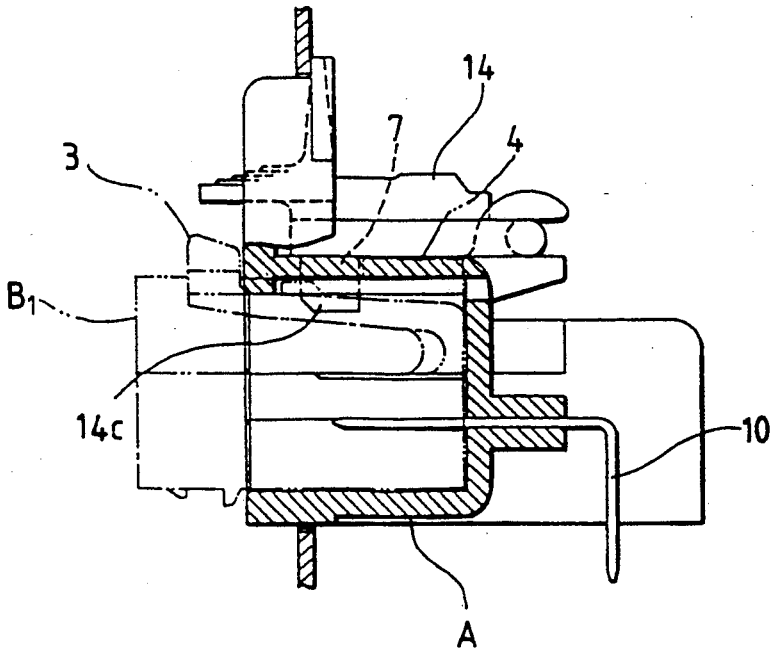

In the above construction, when the male housing B1 (B2, B3) is inserted into the fitting chamber $5_1$ of the female housing A, the locking arm 3 is flexed downward as shown in FIG. 10*a*, and when the complete fitting is achieved, the arm 3 is restored into its initial form, so that the retaining projection 3*a* is engaged with the retaining portion 8 to achieve a first-stage lock as shown in FIG. 10*b*.

When the fitting is to be effected, the projection 4 of the male housing B1 enters the fitting chamber $5_1$ through the introduction slit 7 (see FIGS. 1 and 9); however, in the half-fitted condition shown in FIG. 10*a*, the projection 14*c* of the lock lever 14 interferes with the projection 4, and therefore the lever 14 can not be closed (that is, the complete locking later described can be made). In the completely-locked condition shown in FIG. 10*b*, the projection 14*c* of the lock lever 14 is disposed rearwardly of the projection 4, and therefore can enter the interior through the slit 7, so that the lever 14 can be closed. With the engagement between the projection 14*c* and the projection 4, the male housing B1 is locked relative to the female housing A (i.e., the fitting chamber $5_1$) in a double manner. With this arrangement, the electrical connection between the group of female terminals 2 and the group of L-shaped terminals 10 is achieved at the same time.

Thus, if any one of the male housings B1, B2 and B3 is in a half-fitted condition, the lock lever 14 can not be closed, and the closing of this lever 14 means that every male housing has been mechanically locked in a double manner.

The switch terminal C electrically detects the above mechanical double lock.

Figure 11A:
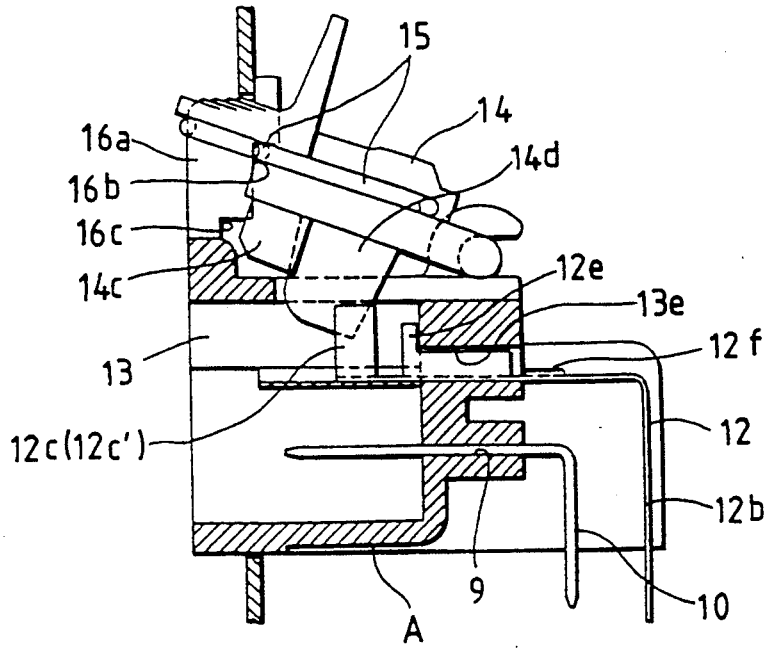
FIGS. 11*a* and 11*b* are fragmentary cross-sectional views showing the operations of the switch terminal C of FIG. 1 and the lock lever 14.
Figure 11B:
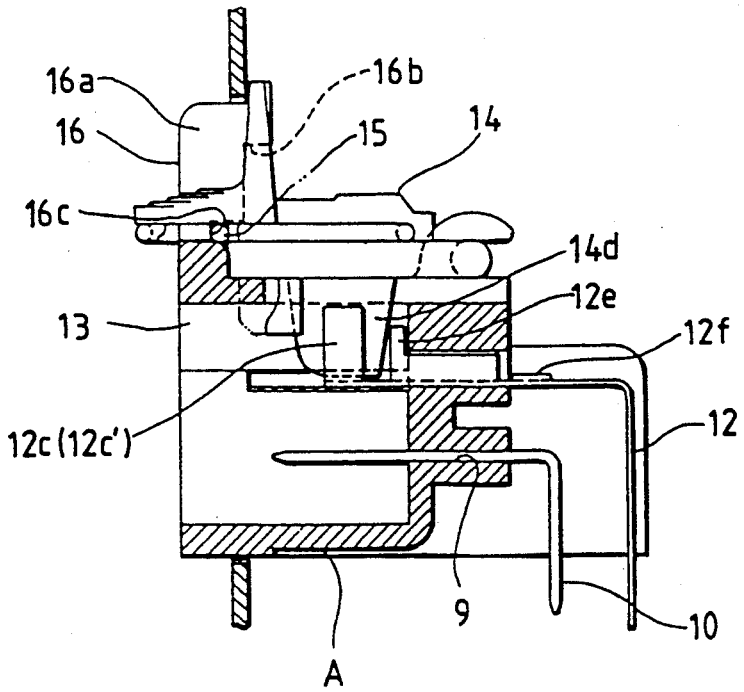
Figure 12:
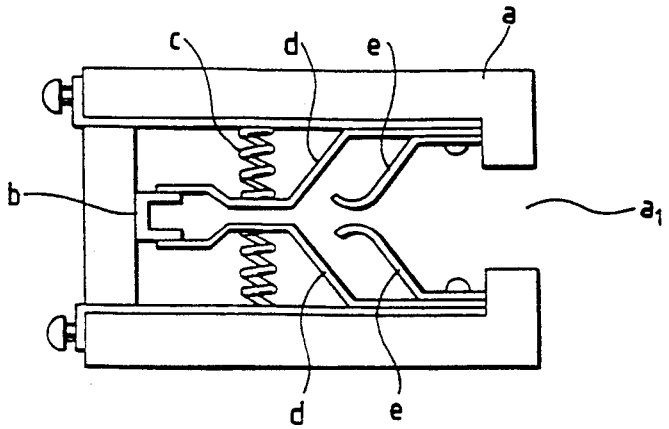
FIG. 12 PRIOR ART
FIG. 12 is a cross-sectional view of a conventional switch terminal.
Figure 13A:
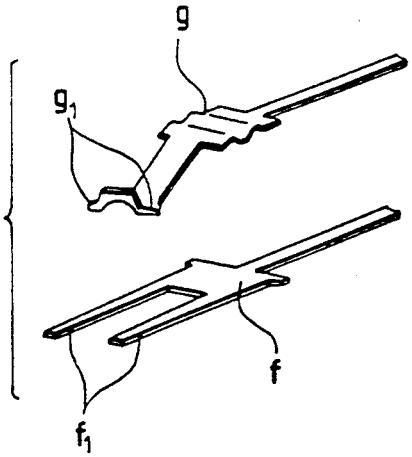
FIG. 13(a) PRIOR ART
FIGS. 13*a* and 13*b* are a perspective view of a switch mechanism of a conventional coaxial connector with a switch and a cross-sectional view of this connector, respectively.
Figure 13B:
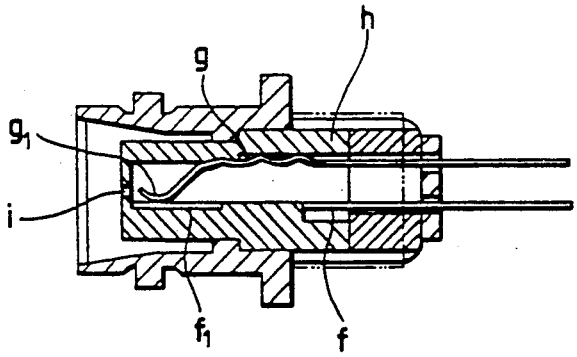
FIG. 13(b) PRIOR ART

FIGS. 11*a* and 11*b* shows the operations of the switch terminal C and the lock lever 14, and for the sake of simplicity of the illustration, the male housings B1, B2 and B3 are omitted from these Figures.

In FIG. 11*a*, the lock lever 14 is inclined relative to the hood 5 and is held in the provisionally-locked condition, with the lock spring 15 engaged in the provisionally-locking grooves 16*b* of the lock plates 16. As shown in FIG. 10*a*, in this provisionally-locked condition, the male housing Bl can be freely fitted and removed. The insulating projection 14*d* on the lower surface of the lock lever 14 is projected into the switch terminal receiving chamber 13 through the slit 7' (see FIG. 9), and is disposed between the spring contact portions 12*c* and 12*c'* of the switch terminal C, but the ends 12*c*2 and 12*c*2 of the folded portions are held in contact with each other.

In FIG. 11*b*, all of the male housings B1 to B3 are in the completely-fitted condition, and the lock lever 14 is in the completely-locked condition. Namely, the lock lever 14 is pressed down from the condition shown in FIG. 11*a*, so that the lock spring 15 is lockingly engaged with the completely-locking grooves 16*c*, and at the same time the insulating projection 14*d* intrudes between the ends 12*c*2 and 12*c*2 of the folded portions of the spring contact portions 12*c* and 12*c'* to interrupt the two connecting pieces 12 and 12' from each other.

The connecting pieces 12 and 12' are connected to an alarm circuit (not shown) via the printed circuit board 11, and a display, such as the turning-on and -off of an alarm lamp, is adapted to be made. With this arrangement, the complete fitting between the female and male housings A and B1 (B2, B3), as well as the double lock thereof, can be electrically confirmed, thereby ensuring the safety of the circuit.

As described above, in the present invention, the switch terminal, before inserted into the female housing, is provided as one component part, and therefore the number of the component parts can be reduced, and the attachment of the switch terminal to the housing can be effected efficiently.

Further, this switch terminal is used in combination with the lock lever which effects the double lock of the female and male housings, and with this arrangement the half-fitting of the connector is prevented, and there can be provided the electric connector extremely enhanced in electrical connection.

What is claimed is:

1. A switch terminal for electrically confirming complete engagement of male and female connector housings to each other, said terminal being disposed in one of said housing and comprising:

a pair of connector pieces each having a base plate portion which has a terminal portion at one end thereof and a spring contact portion at the other end thereof; and connective portions interconnecting said base plate portions of said two connecting pieces in parallel relation to each other, said connective portions adapted to be removed upon insertion of said terminal in said one housing, wherein each of said spring contact portions is bent into an arcuate configuration from an outer side edge of said base plate portion toward an inner side edge thereof to provide a folded portion, and distal ends of said folded portions contact each other to thereby provide a normally-closed contact when disposed in said one housing, and wherein complete engagement of said housings to each other causes said distal ends to break contact from each other as an indication of said complete engagement.

2. A connector with a switch terminal, comprising:

a switch terminal including a pair of connecting pieces each having a base plate portion which has a terminal portion at one end thereof and a spring contact portion at the other end thereof, and connective portions interconnecting said base plate portions of said two connecting pieces in parallel relation to each other, each of said spring contact portions being bent into an arcuate configuration from an outer side edge of said base plate portion toward an inner side edge thereof to provide a folded portion, and distal ends of said folded portions being capable of contacting each other to thereby provide a normally-closed contact; and a connector housing having a switch terminal receiving chamber, said switch terminal receiving chamber including a partition rib provided on a wall surface of said chamber and extending in a longitudinal direction of said housing for isolating said pair of connecting pieces of said switch terminal from each other, guide walls which converge in said longitudinal direction in a tapered manner on opposite side walls of said switch terminal receiving chamber at a terminal inlet portion thereof, said partition rib being disposed between said opposite side walls;

wherein when said switch terminal is inserted into said switch terminal receiving chamber, said pair of spring contact portions are urged b said tapered guide walls, so that said distal ends of said folded portions are contacted with each other to form the normally-closed contact; and wherein said connective portions are adapted to be removed from said terminal such that said pair of connecting pieces only contact each other at said distal ends.

3. A connector with a switch terminal according to claim 2, further comprising a lock lever pivotally attached to said housing and adapted to be closed when a mating connector housing is completely engaged in said connector housing which receives said switch terminal, said lock lever having an insulating projection which is insertable between said distal ends of said pair of folded portions forming the normally-closed contact of said switch terminal, thereby breaking said normally-closed contact.

4. A connector comprising:

a plurality of male housings each having terminal receiving chambers for receiving and retaining a female terminal;

a female housing in which said male housings are fittingly received;

a lock lever pivotally attached to said female housing, said lock lever being closed only when each of said male housing is completely lockingly fitted in said female housing;

a first locking means provided on each of said male housings and said female housing for locking each other together;

a second locking means provided on each of said male housings and lock lever for locking each of said male housings and said female housing together; and means for electrically detecting whether each of said male housings and said female housing are completely fitted and locked to each other, said detecting means comprising:

a switch terminal including a pair of connecting pieces each having a spring contact portion, a pair of said spring contact portions being normally contacted with each other to be electrically closed;

a switch terminal receiving chamber provided to said female housing; and an insulating member provided on said lock lever for being inserted between said spring contact portions so as to interrupt electrical contact therebetween when said male housing and female housing are completely fitted to each other and said lock lever is closed, wherein said switch terminal receiving chamber comprises:

a partition rib provided on a wall surface of said chamber for isolating said pair of connecting pieces of said switch terminal from each other, and guide walls which converge forwardly in a tapered manner on opposite side walls of said chamber at a terminal inlet portion thereof, said partition rib being disposed between said opposite side walls, wherein said pair of spring contact portions are urged by said guide walls so that ends of said spring contact portions are contacted with each other to form the normally-closed contact, when said switch terminal is inserted into said switch terminal receiving chamber.

5. A connector according to claim 4, wherein said first locking means comprises:

a locking arm provided on each of said male housings; and a retaining member provided on an inner wall of said female housing for engaging with said locking arm and for retaining said male housing in said female housing when said male housing is completely fitted in said female housing.

6. A connector according to claim 4, wherein said female housing has a plurality of slits and said second locking means comprises:

a first projection provided on each of said male housings, each said first projection being fittingly inserted in said female housing through a respective said slit; and a second projection provided on said lock lever for engaging with said first projection, when said male housing is completely fitted in said female housing.

7. A connector according to claim 4, wherein said switch terminal comprises:

said pair of connecting pieces each having a base plate portion which has a terminal portion at one end thereof and said spring contact portion at the other end thereof; and connective portions interconnecting said base plate portions in parallel relation to each other, wherein each of said spring contact portions is bent into an arcuate configuration from an outer side edge of said base plate portion toward an inner side edge thereof to provide a folded portion, and distal ends of said folded portions are capable of contacting each other to thereby provide a normally-closed contact.

8. A connector according to claim 7, wherein said pair of connecting pieces are adapted to be insulatively separated from each other by removing said connective portion.

* * * * *